US009539814B2

(12) United States Patent
Chen et al.

(10) Patent No.: US 9,539,814 B2
(45) Date of Patent: Jan. 10, 2017

(54) MOLDED PRINTHEAD

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/770,762

(22) PCT Filed: Dec. 13, 2013

(86) PCT No.: PCT/US2013/074925
§ 371 (c)(1),
(2) Date: Aug. 26, 2015

(87) PCT Pub. No.: WO2014/133633
PCT Pub. Date: Sep. 4, 2014

(65) Prior Publication Data

US 2016/0001558 A1 Jan. 7, 2016

(30) Foreign Application Priority Data

Feb. 28, 2013 (WO) ..... PCT/US2013/028216
Jun. 17, 2013 (WO) ..... PCT/US2013/046065

(51) Int. Cl.
*B41J 2/16* (2006.01)
*B41J 2/14* (2006.01)

(52) U.S. Cl.
CPC ..... *B41J 2/1637* (2013.01); *B41J 2/14* (2013.01); *B41J 2/16* (2013.01);
(Continued)

(58) Field of Classification Search
CPC ..... B41J 2/1637; B41J 2/162; B41J 2/16; B41J 2/14
See application file for complete search history.

(56) References Cited

U.S. PATENT DOCUMENTS 4,633,274 A 12/1986 Matsuda
4,873,622 A 10/1989 Komuro et al.
(Continued)

FOREIGN PATENT DOCUMENTS

DE 102011084582 2/2013
EP 1095773 5/2001
(Continued)

OTHER PUBLICATIONS

International Search Report & Written Opinion received for PCT Application No. PCT/US2013/074925, Mar. 20, 2014, 14 pages.
(Continued)

*Primary Examiner* — Jason Uhlenhake
(74) *Attorney, Agent, or Firm* — HP Inc—Patent Department

(57) ABSTRACT

In one example, a molded printhead includes a printhead die embedded in a molding and an external electrical contact electrically connected to the printhead die and exposed outside the molding to connect to circuitry external to the printhead. The molding has a channel therein through which fluid may pass to the back part of the die. The front part of the die is exposed outside the molding and the back part of the die is covered by the molding except at the channel and the thickness of the molding varies from a lesser thickness around the die to a greater thickness away from the die.

14 Claims, 19 Drawing Sheets

(52) U.S. Cl.
CPC .. *B41J 2002/14491* (2013.01); *B41J 2202/19* (2013.01); *B41J 2202/20* (2013.01)

(56) References Cited

U.S. PATENT DOCUMENTS

| | | | | |
|---|---|---|---|---|
| 6,145,965 | A | 11/2000 | Inada et al. | |
| 6,250,738 | B1 | 6/2001 | Waller et al. | |
| 6,554,399 | B2 | 4/2003 | Wong et al. | |
| 6,896,359 | B1 * | 5/2005 | Miyazaki | B41J 2/14024 347/58 |
| 7,490,924 | B2 | 2/2009 | Haluzak et al. | |
| 7,498,666 | B2 | 3/2009 | Hussa | |
| 7,591,535 | B2 | 9/2009 | Nystrom et al. | |
| 7,658,470 | B1 | 2/2010 | Jones et al. | |
| 7,824,013 | B2 | 11/2010 | Chung-Long et al. | |
| 7,877,875 | B2 | 2/2011 | O'Farrell et al. | |
| 8,197,031 | B2 | 6/2012 | Stephens et al. | |
| 8,235,500 | B2 | 8/2012 | Nystrom et al. | |
| 8,246,141 | B2 | 8/2012 | Petruchik et al. | |
| 8,272,130 | B2 | 9/2012 | Miyazaki | |
| 8,287,104 | B2 | 10/2012 | Sharan et al. | |
| 8,342,652 | B2 | 1/2013 | Nystrom et al. | |
| 8,476,748 | B1 | 7/2013 | Darveaux et al. | |
| 2002/0030720 | A1 | 3/2002 | Kawamura et al. | |
| 2002/0122097 | A1 | 9/2002 | Beerling et al. | |
| 2002/0180825 | A1 | 12/2002 | Buswell et al. | |
| 2004/0032468 | A1 | 2/2004 | Killmeier et al. | |
| 2005/0024444 | A1 | 2/2005 | Conta et al. | |
| 2006/0209110 | A1 | 9/2006 | Vinas et al. | |
| 2006/0280540 | A1 | 12/2006 | Han | |
| 2007/0153070 | A1 | 7/2007 | Haines et al. | |
| 2008/0079781 | A1 | 4/2008 | Shim et al. | |
| 2008/0259125 | A1 | 10/2008 | Haluzak et al. | |
| 2009/0225131 | A1 | 9/2009 | Chen et al. | |
| 2010/0271445 | A1 | 10/2010 | Sharan et al. | |
| 2011/0019210 | A1 | 1/2011 | Chung et al. | |
| 2011/0037808 | A1 * | 2/2011 | Ciminelli | B41J 2/14072 347/50 |
| 2011/0080450 | A1 | 4/2011 | Ciminelli et al. | |
| 2011/0141691 | A1 | 6/2011 | Slaton et al. | |
| 2011/0222239 | A1 | 9/2011 | Dede | |
| 2011/0292126 | A1 | 12/2011 | Nystrom et al. | |
| 2011/0298868 | A1 | 12/2011 | Fielder et al. | |
| 2012/0019593 | A1 | 1/2012 | Scheffelin et al. | |
| 2012/0061857 | A1 | 3/2012 | Ramadoss et al. | |
| 2012/0098114 | A1 | 4/2012 | Ishibashi | |
| 2012/0124835 | A1 | 5/2012 | Okano et al. | |
| 2012/0186079 | A1 | 7/2012 | Ciminelli | |
| 2012/0210580 | A1 | 8/2012 | Dietl | |
| 2012/0212540 | A1 | 8/2012 | Dietl | |

FOREIGN PATENT DOCUMENTS

| | | |
|---|---|---|
| JP | 2001071490 | 3/2001 |
| JP | 2000108360 | 4/2001 |
| JP | 2006321222 | 11/2006 |
| JP | 2010137460 | 6/2010 |
| WO | WO-2012134480 | 10/2012 |

OTHER PUBLICATIONS

Kumar, Aditya et al; Wafer Level Embedding Technology for 3D Wafer Level Embedded Package; Institute of Microelectronics, A*Star; 2Kinergy Ltd, TECHplace II; 2009 Electronic Components and Technology Conference.

Lee et al; A Thermal Inkjet Printhead with a Monolithically Fabricated Nozzle Plate and Self-aligned Ink Feed Hole; Journal of Microelectromechanical Systems; vol. 8, No. 3; Sep. 1999; pp. 229-236.

Lindemann, T. et al.; One Inch Thermal Bubble Jet Printhead with Laser Structured Integrated Polyimide Nozzle Plate; http://ieeexplore.ieee.org/stamp/stamp.jsp?tp=&arnumber=41; On pp. 420-428; vol. 16; Issue 2; Apr. 2007.

Yim, M.J. et al.; Ultra Thin Pop Top Package Using Compression Mold; It's Warpage Control; http://ieeexplore.ieee.org/xpl/articleDetails.jsp?tp=&arnumber=5898654 &queryText%3Dmold+cap+thick* >; On pp. 1141-1146; May 31-Jun. 3, 2011.

* cited by examiner

MOLDED PRINTHEAD

BACKGROUND

Conventional inkjet printheads require fluidic fan-out from microscopic ink dispensing chambers to macroscopic ink supply channels.

DRAWINGS

Figure 2:
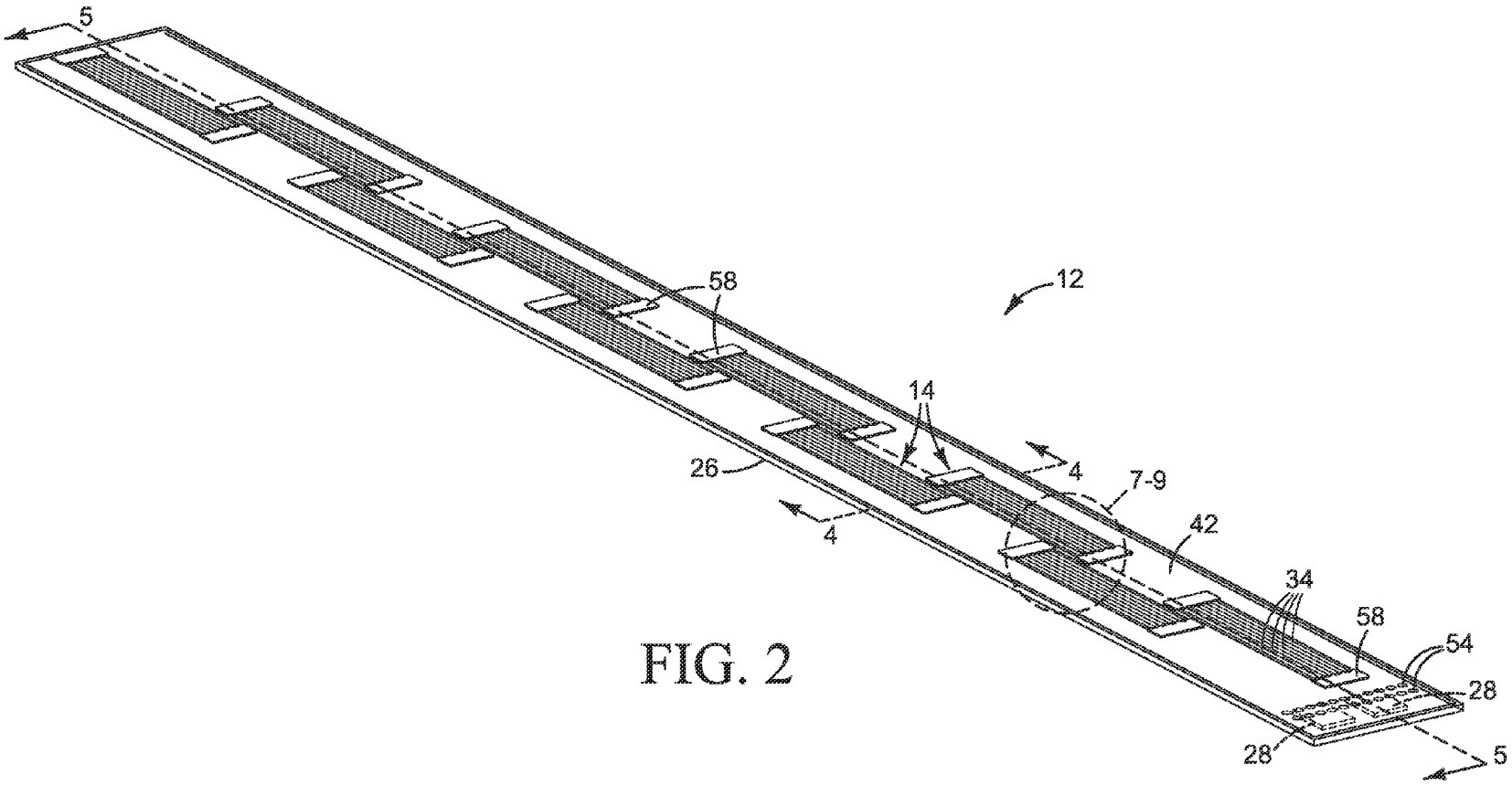
FIGS. 2 and 3 are perspective front and back views, respectively, illustrating one example of a molded print bar such as might be used in the printer shown in FIG. 1.
Figure 4:
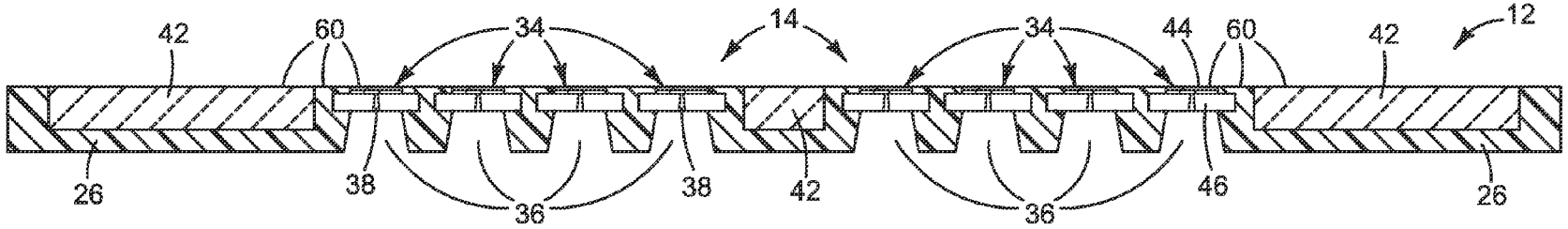
Figure 5:
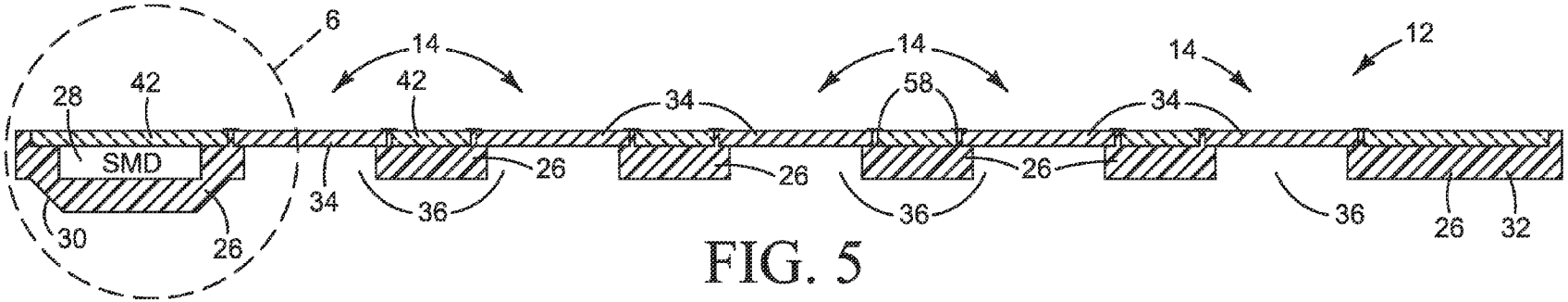

FIGS. 4 and 5 are section views taken along the lines 4-4 and 5-5, respectively, in FIG. 2.

Figure 6:
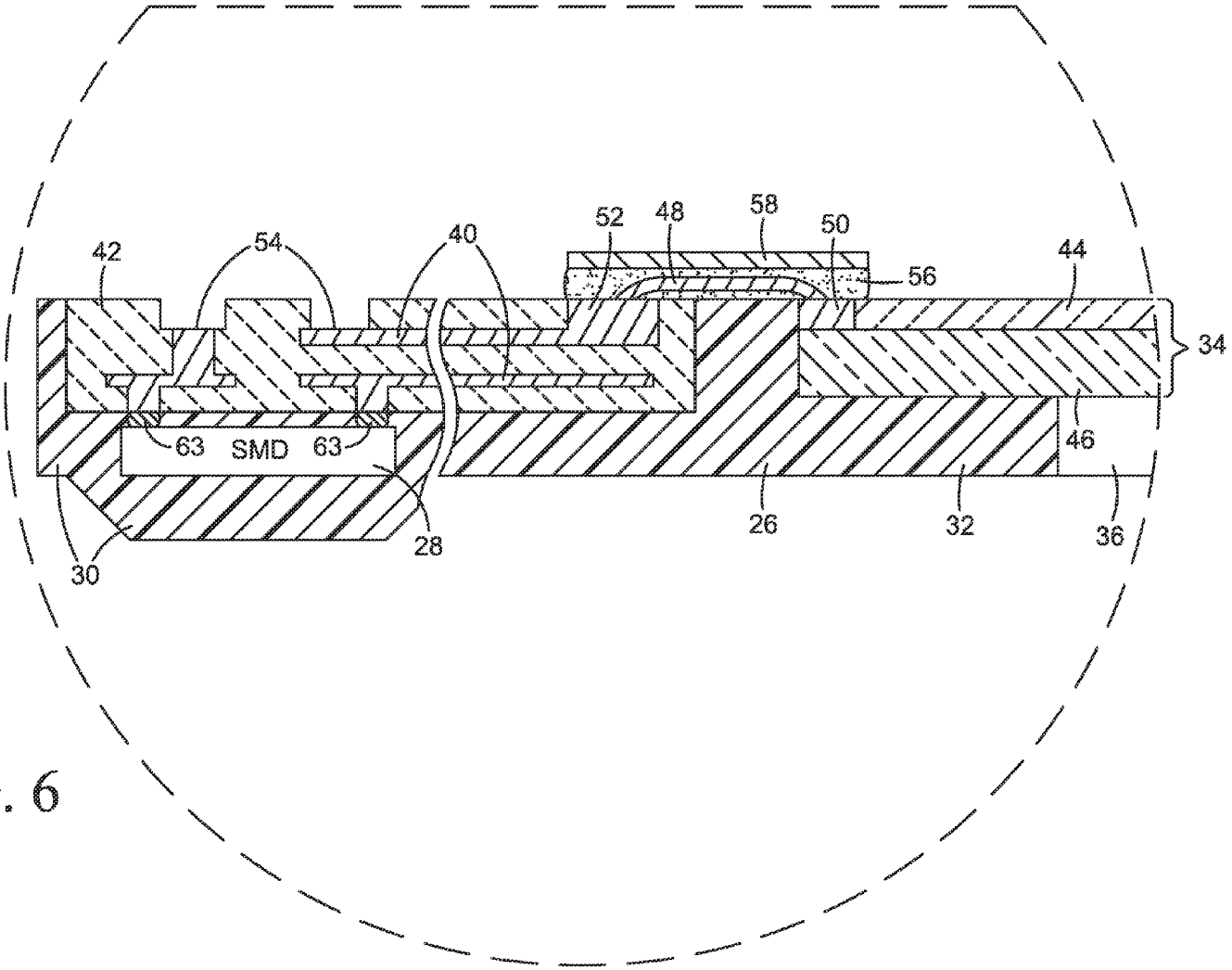

FIG. 6 is a detail from FIG. 5.

Figure 7:
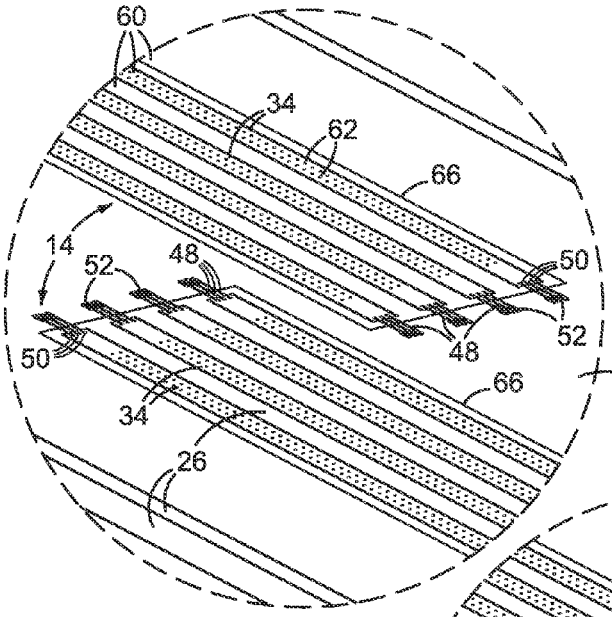
Figure 8:
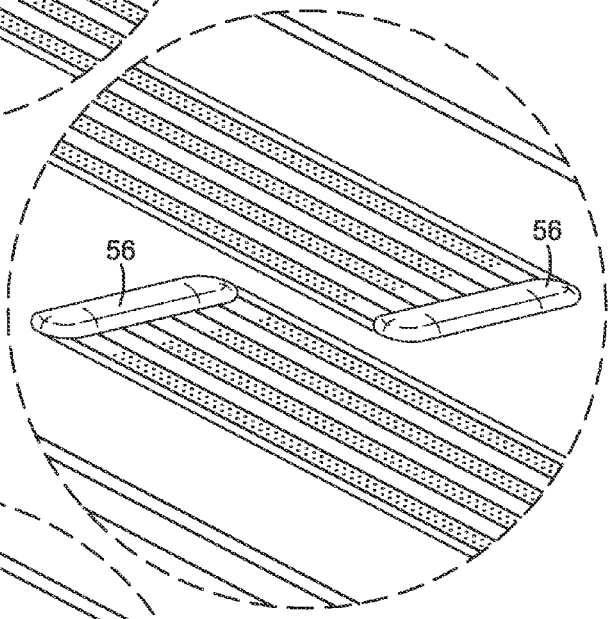
Figure 9:
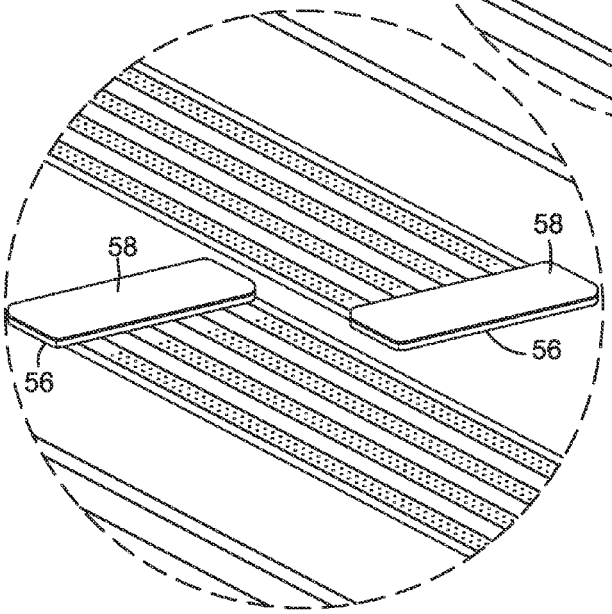

FIGS. 7-9 are details from FIG. 2.

FIGS. 10-17 illustrate one example process for making a molded print bar such as the print bar shown in FIG. 2.

Figure 18:
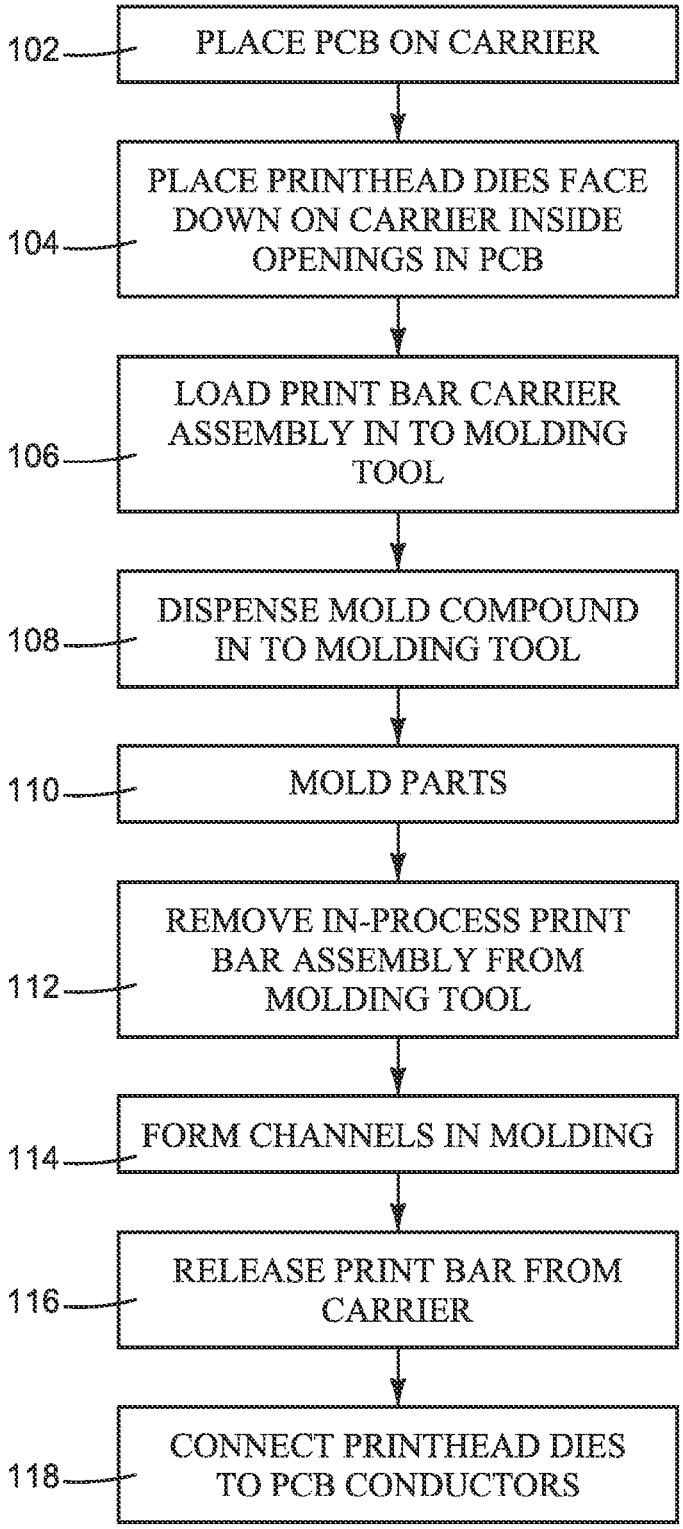

FIG. 18 is a flow diagram of the process illustrated in FIGS. 10-17.

Figure 19:
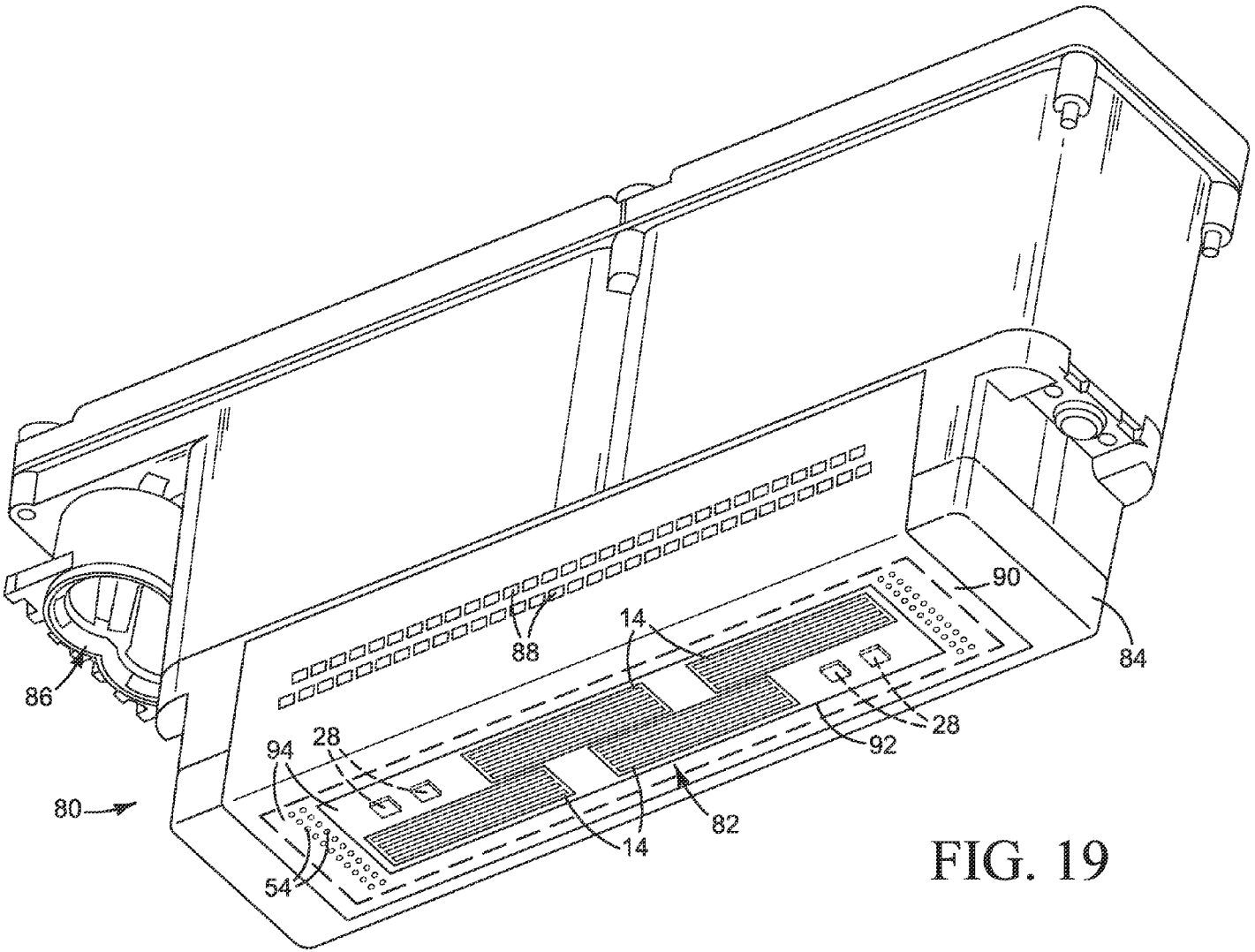

FIG. 19 illustrates an ink cartridge implementing one example of a new molded printhead assembly.

Figure 20:
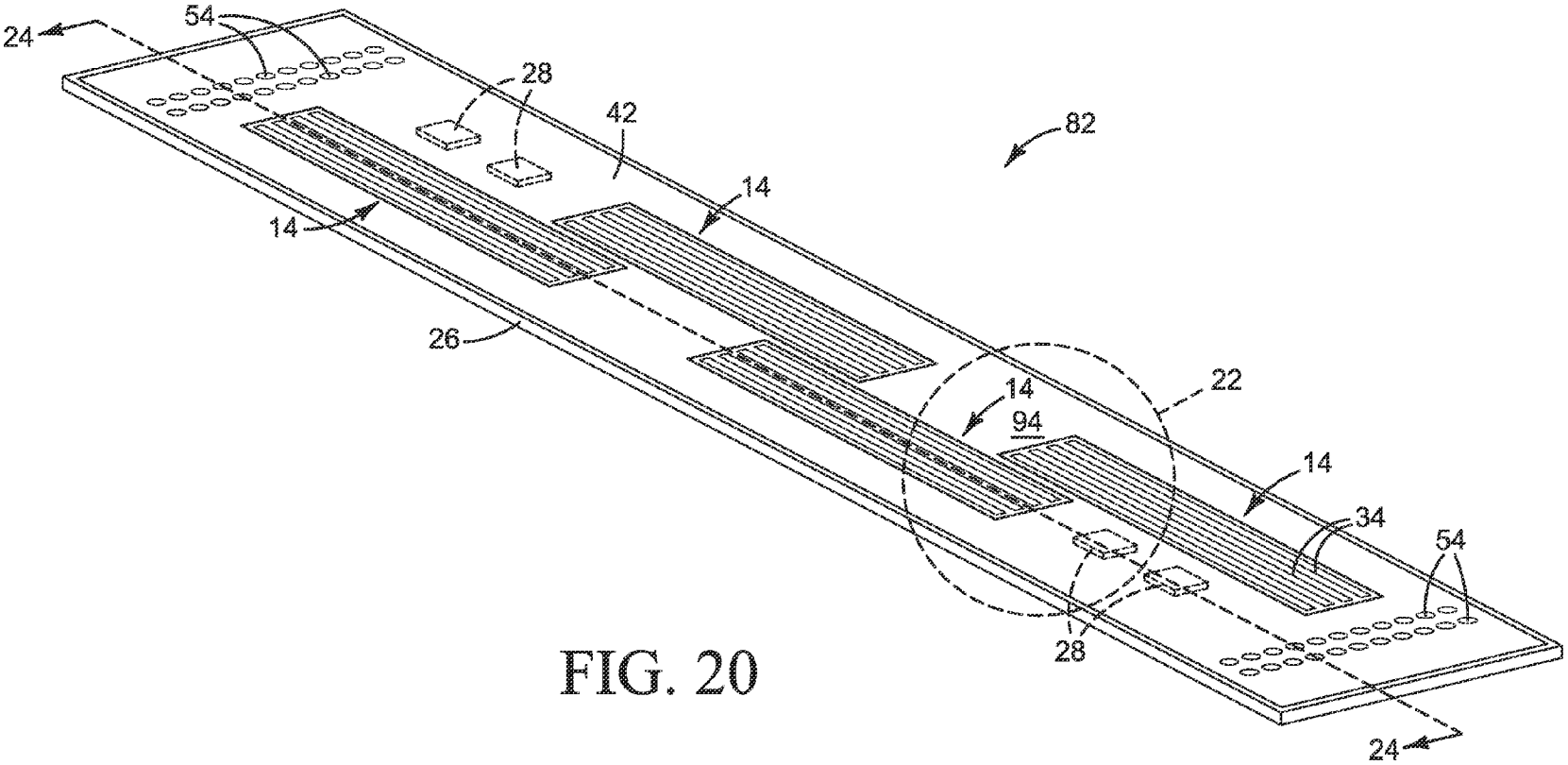
Figure 21:
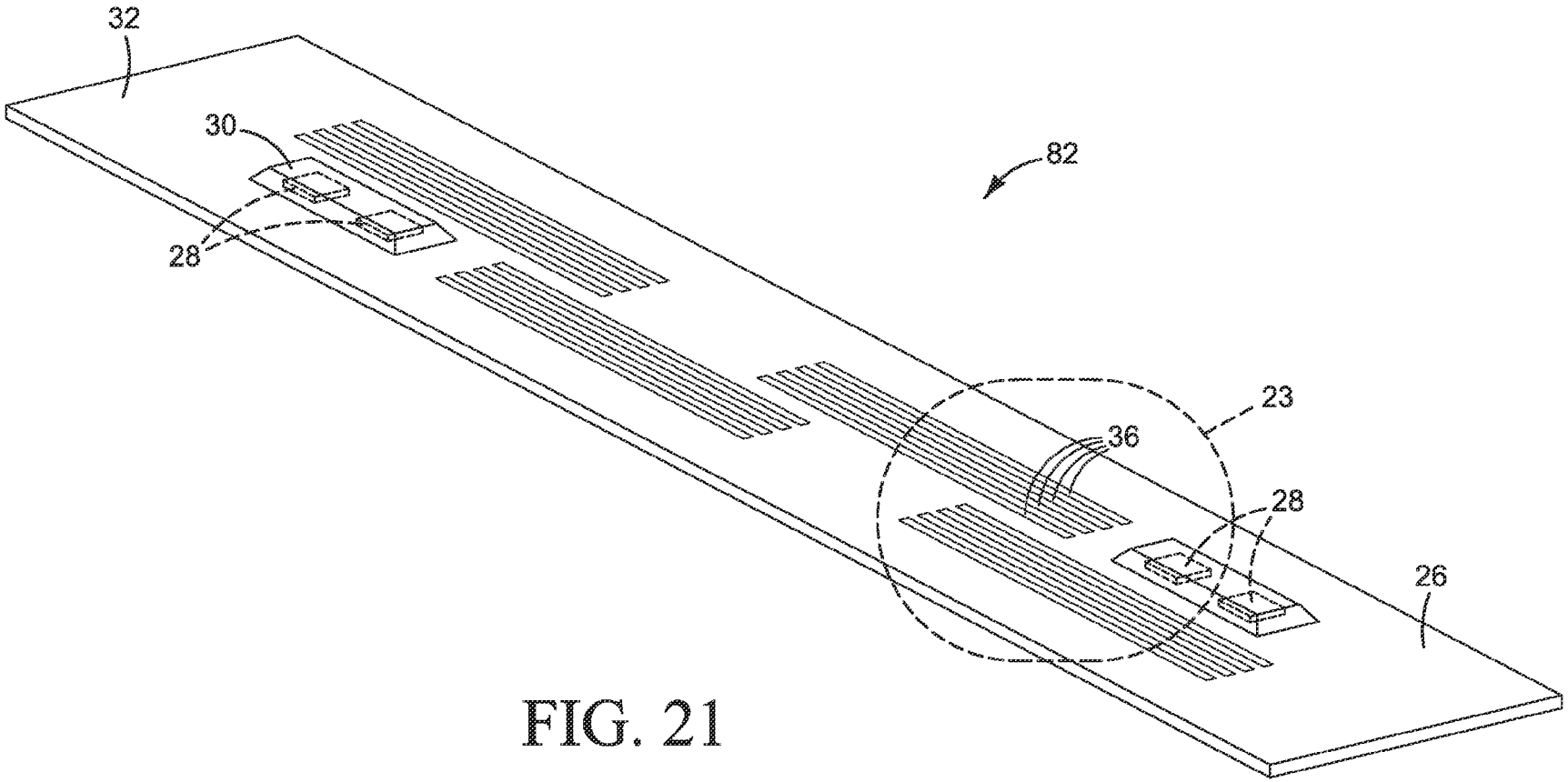

FIGS. 20 and 21 are perspective front and back views, respectively, of the printhead assembly in the ink cartridge shown in FIG. 19.

Figure 22:
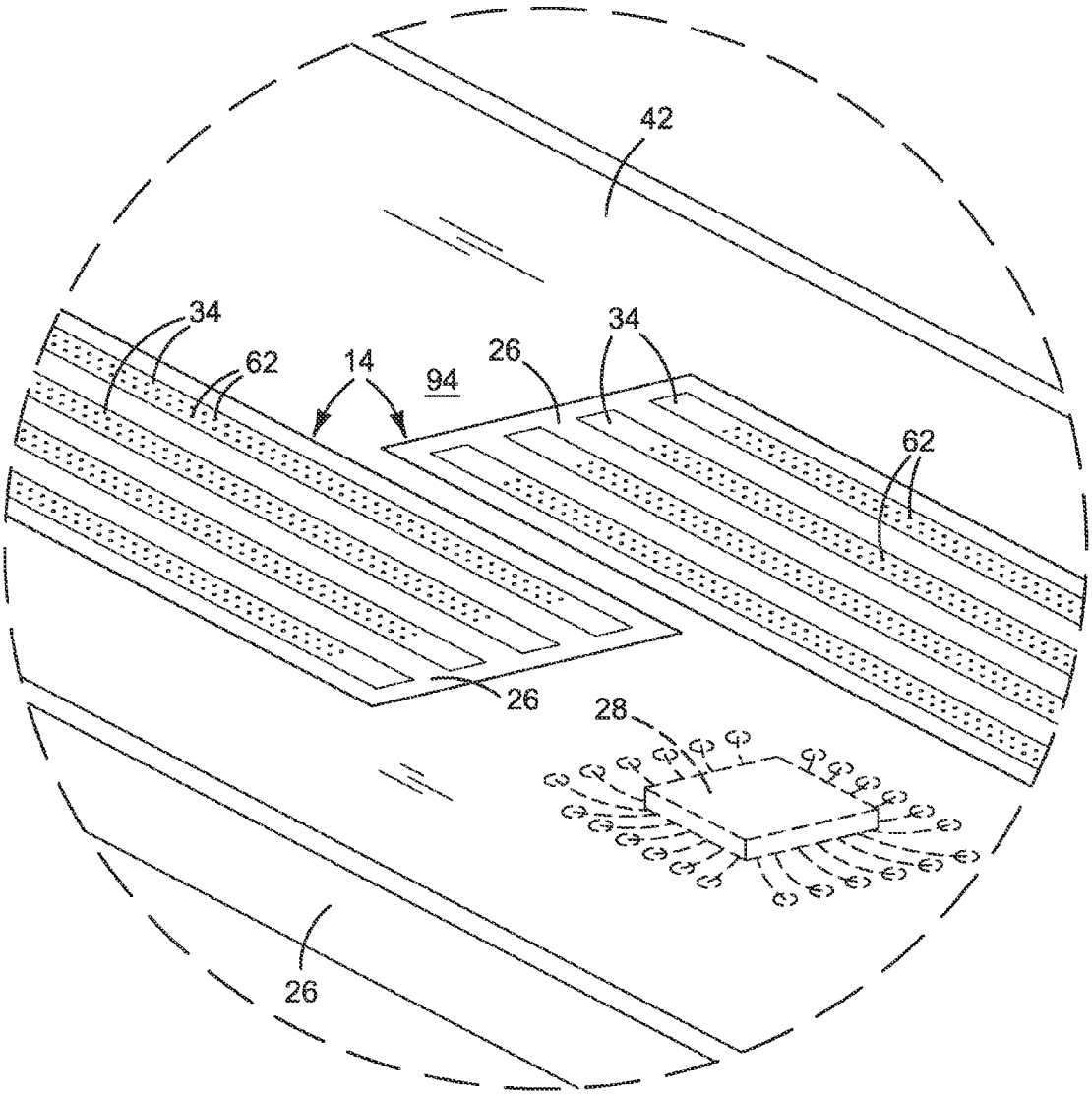

FIG. 22 is a front side detail from FIG. 20.

Figure 23:
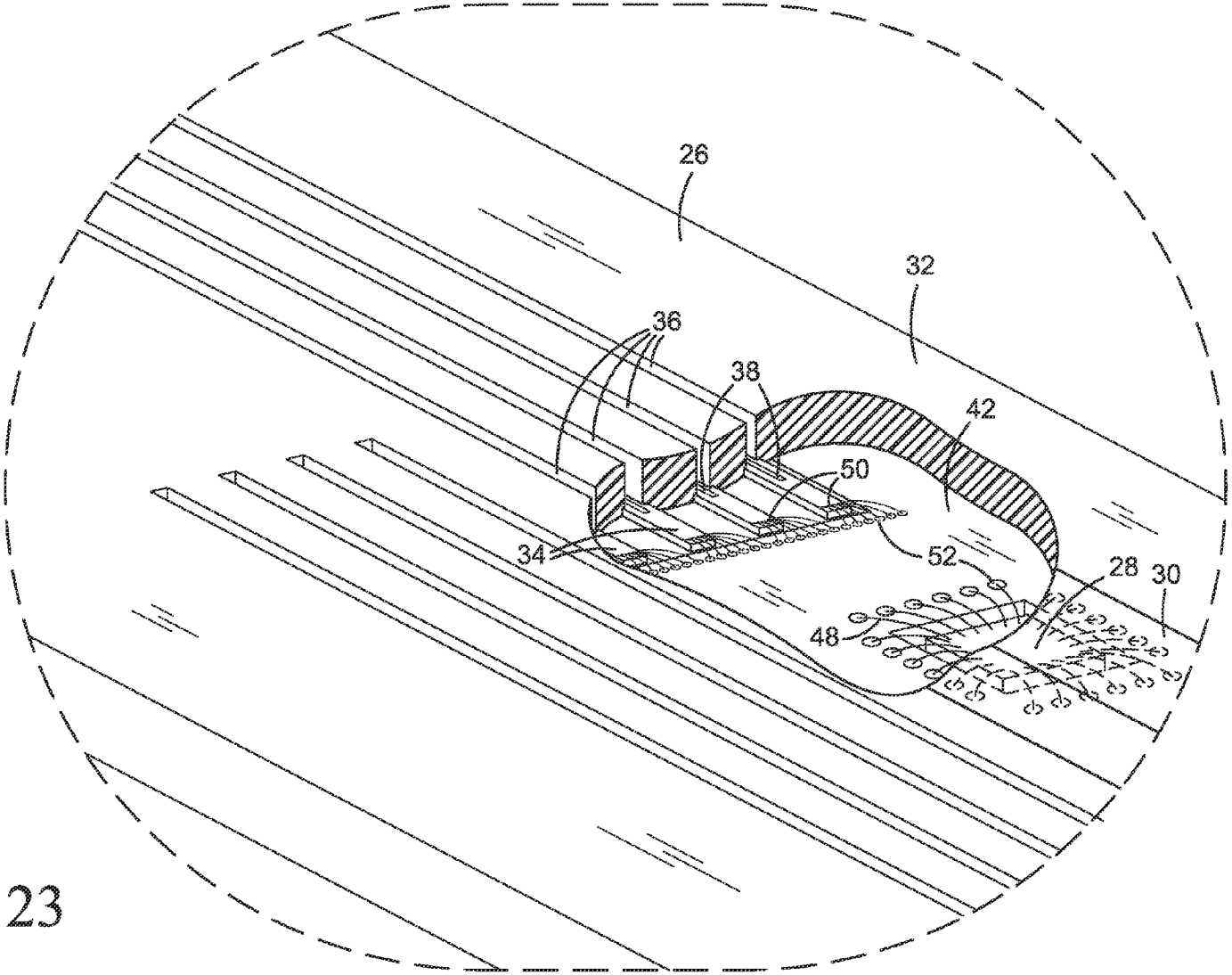

FIG. 23 is a back side detail from FIG. 21.

Figure 24:
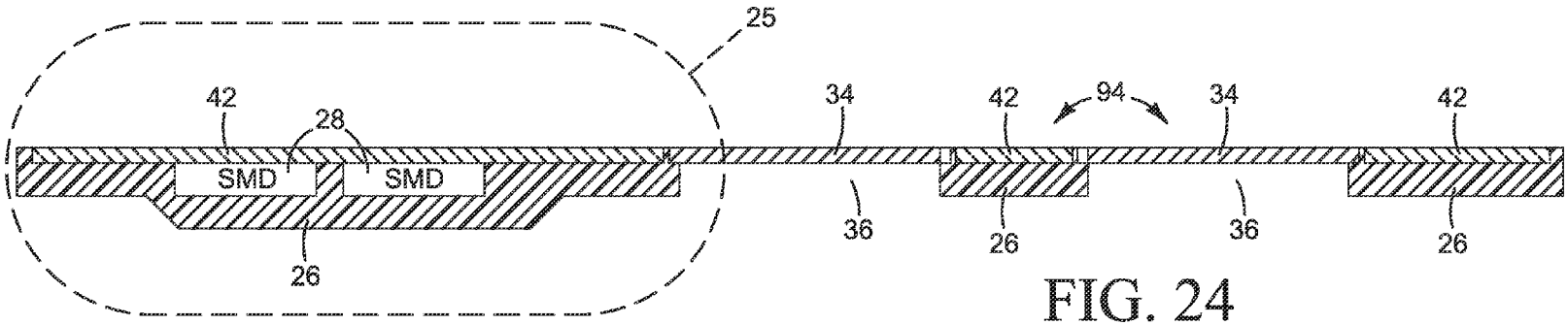

FIG. 24 is a section taken along the line 24-24 in FIG. 20.

Figure 25:
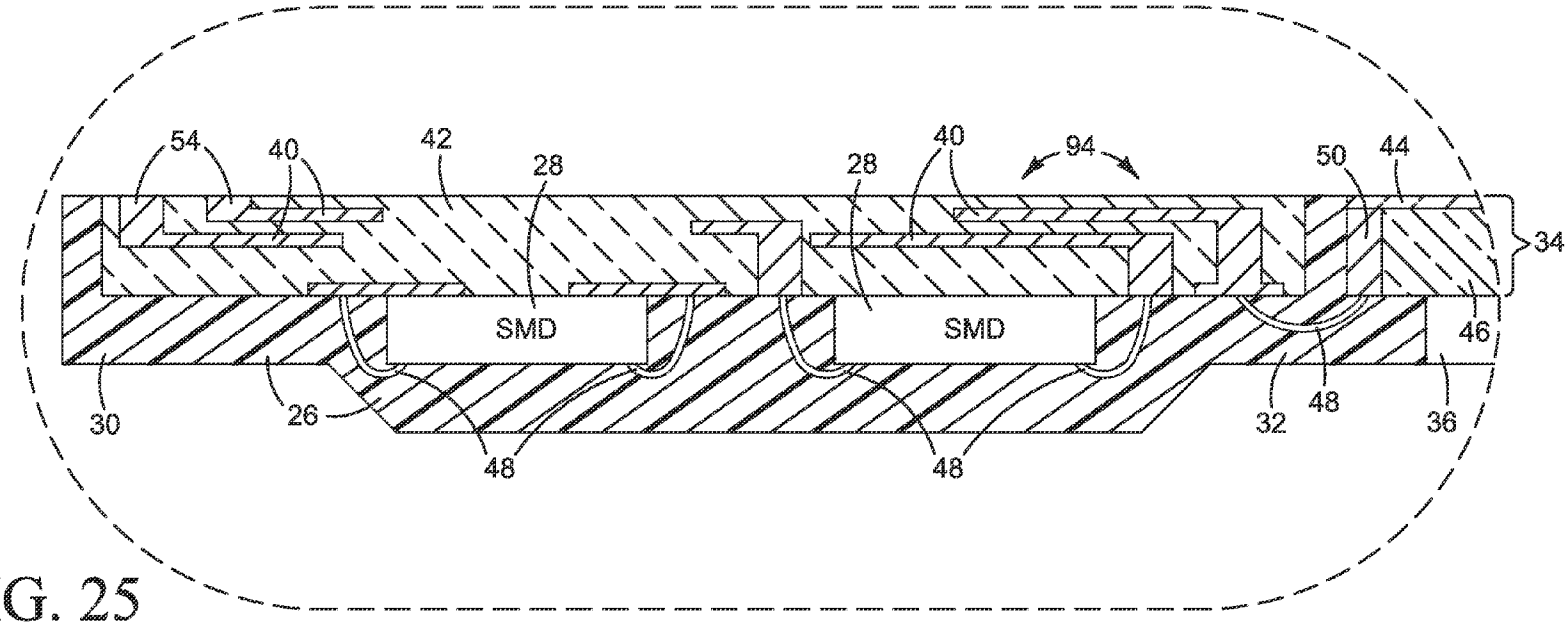

FIG. 25 is a detail from FIG. 24.

The same part numbers designate the same or similar parts throughout the figures. The figures are not necessarily to scale. The relative size of some parts is exaggerated to more clearly illustrate the example shown.

DESCRIPTION

Conventional inkjet printheads require fluidic fan-out from microscopic ink dispensing chambers to macroscopic ink supply channels. Hewlett-Packard Company has developed new, molded inkjet printheads that break the connection between the size of the die needed for the dispensing chambers and the spacing needed for fluidic fan-out, enabling the use of tiny printhead die "slivers" such as those described in international patent application numbers PCT/US2013/046065, filed Jun. 17, 2013 titled Printhead Die, and PCT/US2013/028216, filed Feb. 28, 2013 title Molded Print Bar, each of which is incorporated herein by reference in its entirety. It may be desirable in some printing applications to utilize an ASIC (application specific integrated circuit) in a print bar for high speed input/output between the printer controller and the print bar as well as to perform some logic functions. A conventional integrated circuit packaging process in which the ASIC is flip chip bonded to a molded die package to form a POP (package on package) package does not work well for a molded print bar since there is no UBM (under bump metallization) on the back part of the molding.

Accordingly, a new molded print bar has been developed in which the thickness of the molding varies to accommodate the use of an ASIC in the print bar. The variable thickness molding allows integrating the ASIC into the molding without increasing the thickness of the print bar in the area of the printhead die slivers. A printed circuit board embedded in the molding may be used to connect the ASIC(s) to the printhead dies and to circuitry external to the print bar, and thus avoid the need to form UBM or other wiring in the molding.

Examples of the new variable thickness molding are not limited to print bars or to the use of ASICs, but may be implemented in other printhead structures or assemblies and with other electronic devices. The examples shown in the figures and described herein illustrate but do not limit the invention, which is defined in the Claims following this Description.

As used in this document, a "printhead" and a "printhead die" mean that part of an inkjet printer or other inkjet type dispenser that dispenses fluid, and a die "sliver" means a printhead die with a ratio of length to width of 50 or more. A printhead includes a single printhead die or multiple printhead dies. "Printhead" and "printhead die" are not limited to printing with ink but also include inkjet type dispensing of other fluids and/or for uses other than printing.

Figure 1:
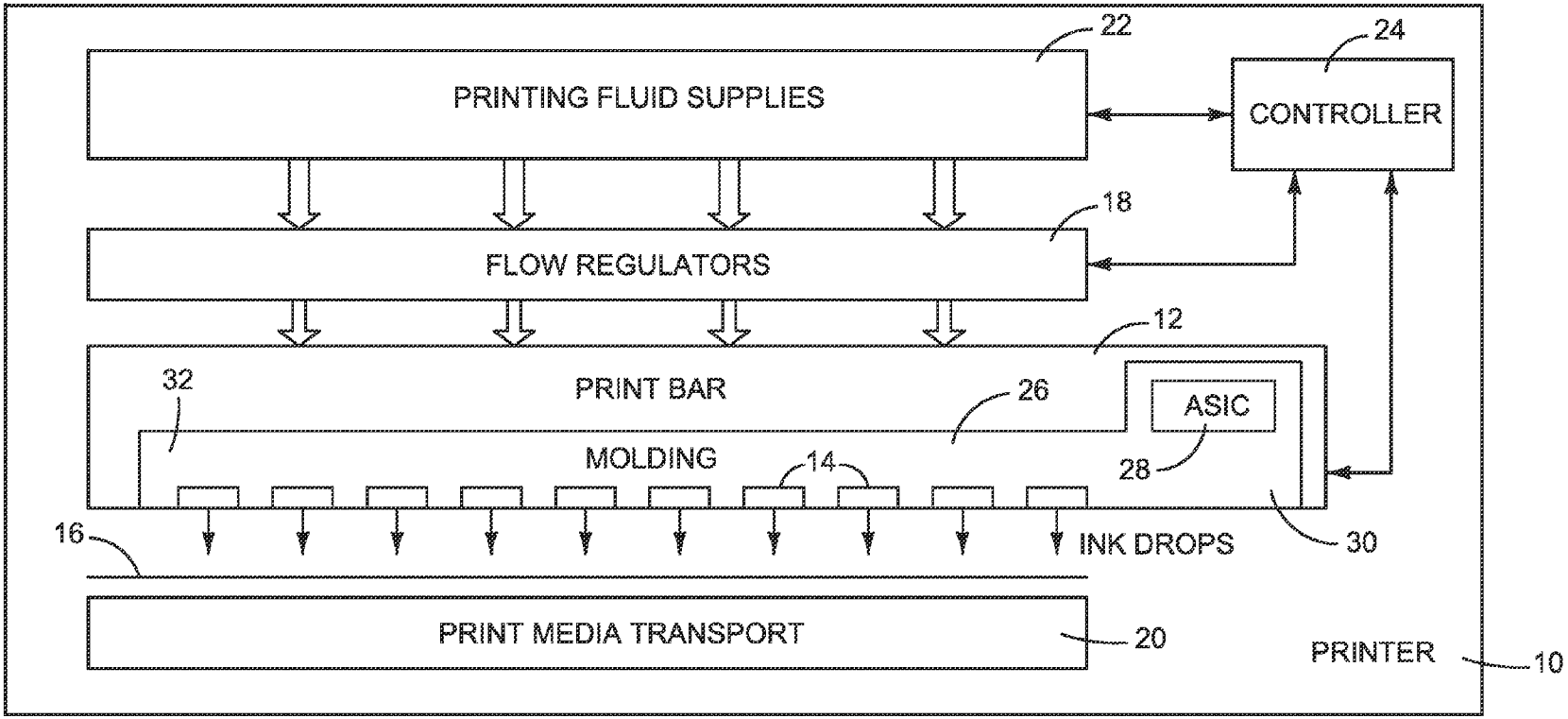
FIG. 1 is a block diagram illustrating an inkjet printer implementing one example of a new molded print bar.

FIG. 1 is a block diagram illustrating an inkjet printer 10 implementing one example of a molded print bar 12. Referring to FIG. 1, printer 10 includes a print bar 12 with an arrangement of printheads 14 spanning the width of a print media 16, flow regulators 18 associated with print bar 12, a print media transport mechanism 20, ink or other printing fluid supplies 22, and a printer controller 24. Controller 24 represents the programming, processor(s) and associated memory(ies), and the electronic circuitry and components needed to control the operative elements of a printer 10. Print bar 12 includes an arrangement of printheads 14 each with a single printhead die or multiple printhead dies embedded in a molding 26 for dispensing printing fluid on to a sheet or continuous web of paper or other print media 16. Print bar 12 also includes an ASIC or other non-printhead die electronic device 28 embedded in molding 26. As described in detail below with reference to FIGS. 4-9, the thickness of molding 26 varies to accommodate ASIC 28 at a thicker part 30 while still maintaining a uniform, thinner part 32 in the print zone spanning the length of printheads 14.

Figure 3:
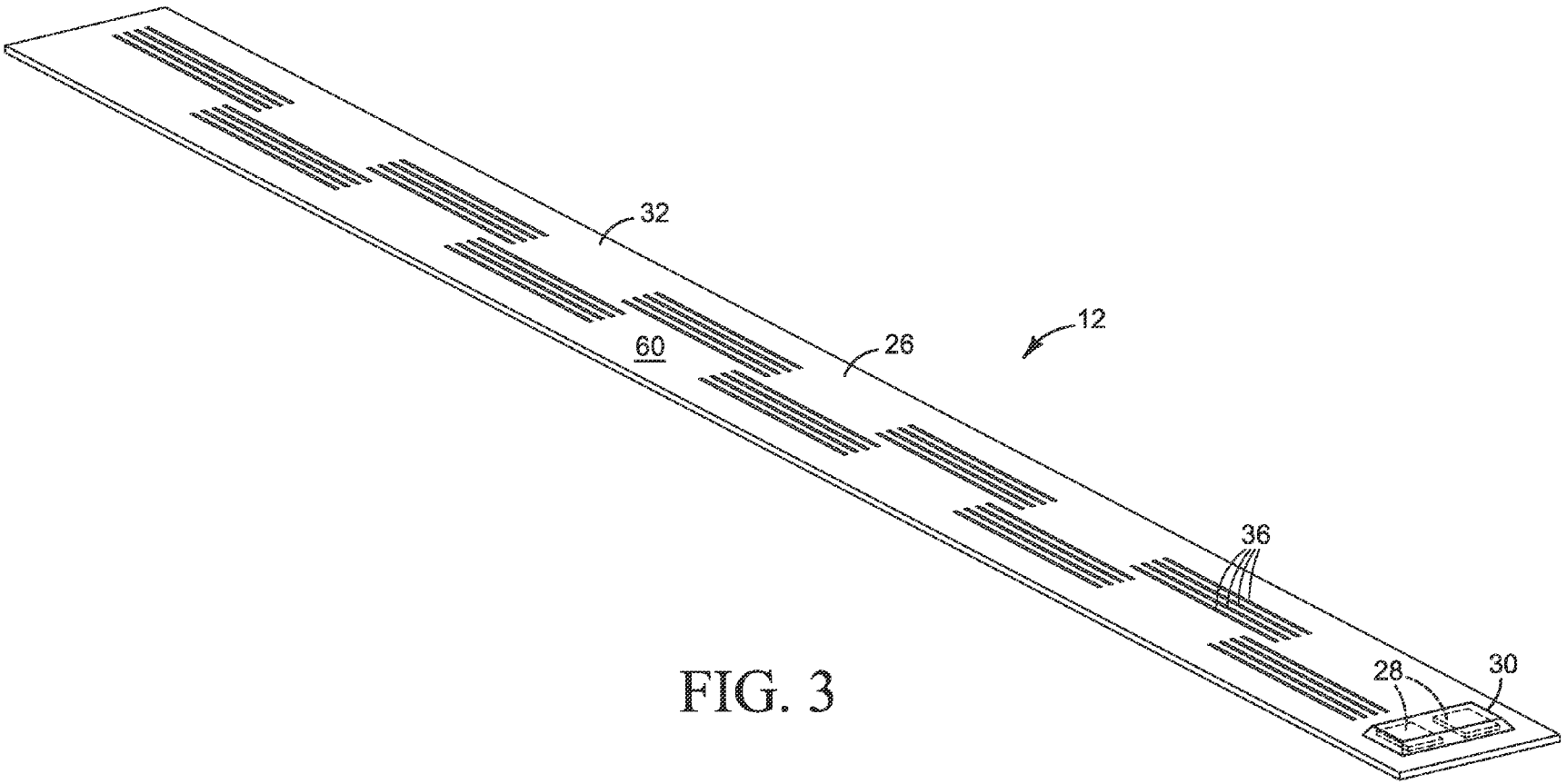

FIGS. 2 and 3 are perspective front and back views, respectively, illustrating one example of a molded print bar 12 such as might be used in printer 10 shown in FIG. 1. FIGS. 4-9 are section and detail views from FIG. 2. (In FIG. 7, the protective coverings on the wire bonds are omitted to show the underlying connections. In FIG. 8, the encapsulant covering the wire bonds is shown and in FIG. 9 the protective cap covering the encapsulant is shown.) Referring to FIGS. 2-9, print bar 12 includes multiple printheads 14 embedded in a monolithic molding 26 and arranged in a row lengthwise along the print bar in a staggered configuration in which each printhead overlaps an adjacent printhead. Although ten printheads 14 are shown in a staggered configuration, more or fewer printheads 14 may be used and/or in a different configuration. Examples are not limited to a media wide print bar. Examples might also be implemented in a scanning type inkjet pen or in a printhead assembly with fewer molded printheads, or even in a single molded printhead.

Each printhead 14 includes printhead dies 34 embedded in molding 26 and channels 36 formed in molding 26 to carry printing fluid directly to corresponding printhead dies 34. In the example shown, as best seen in FIG. 4, channels 36 carry printing fluid directly to inlets 38 at the back part of each die 34. Although four dies 34 arranged parallel to one another laterally across molding 26 are shown for each printhead 14, for printing four different ink colors for example, more or fewer printhead dies 34 and/or in other configurations are possible. As noted above, the development of new, molded inkjet printheads has enabled the use of tiny printhead die "slivers" such as those described in international patent application no. PCT/US2013/046065, filed Jun. 17, 2003 and titled Printhead Die. The molded printhead structures and electrical interconnections described herein are particularly well suited to the implementation of such tiny die slivers 34 in printheads 14.

In the example shown, as best seen in the detail of FIG. 6, the electrical conductors 40 that connect each printhead die 34 to external circuits are routed through a printed circuit board (PCB) 42. A printed circuit board is also commonly referred to as a printed circuit assembly (a "PCA"). Referring specifically to FIG. 6, an inkjet printhead die 34 is a typically complex integrated circuit (IC) structure 44 formed on a silicon substrate 46. PCB conductors 40 carry electrical signals to ejector and/or other elements in the IC part 44 of each die 34. In the example shown, PCB conductors 40 are connected to circuitry in each printhead die 34 through bond wires 48. Each bond wire 48 is connected to bond pads or other suitable terminals 50, 52 at the front part of printhead dies 34 and PCB 42, respectively. Thus, PCB conductors 42 connect printhead dies 34 to exposed contacts 54 for connection to circuits external to print bar 12.

Although other conductor routing configurations are possible, a PCB provides a relatively inexpensive and highly adaptable platform for conductor routing in molded printheads. Similarly, while connectors other than bond wires may be used, bond wire assembly tooling is readily available and easily adapted to the fabrication of printheads 14 and print bar 12. Bond wires 48 may be covered by an epoxy or other suitable protective material 56 as shown in FIGS. 5 and 8. A flat cap 58 may be added as shown in FIG. 9 to form a more flat, lower profile protective covering on bond wires 48. Also, in the example shown, the exposed front part of printhead dies 34 is co-planar with the adjacent surfaces of molding 26 and PCB 42 to present an uninterrupted planar surface 60 surrounding the fluid dispensing orifices 62 in each die 34. (Encapsulant 56 and cap 58 are omitted from FIG. 7 and cap 58 is omitted from FIG. 8 to more clearly show the underlying structures.)

Referring now specifically to FIGS. 2, 3, 5 and 6, print bar 12 includes two non-printhead die electronic devices 28 embedded in molding 26 at the back part of print bar 12. In the example shown, as best seen in FIG. 6, devices 28 are mounted to the back surface of PCB 42 and connected directly to PCB conductors 40 with solder balls 63. Thus devices 28 are denoted in FIGS. 5 and 6 as surface mounted devices (SMDs) 28. Although other mounting techniques are possible for devices 28, surface mounting is desirable to facilitate molding. Electronic devices 28 that might be integrated into an inkjet print bar 12 include, for example, ASICs, EEPROMs, voltage regulators, and passive signal conditioning devices.

The thickness of molding 26 varies to accommodate SMDs 28 at a thicker part 30 while still maintaining a uniform, thinner part 32 in the print zone spanning the length of printheads 14. That is to say, the profile of molding 26 defines a narrower part 32 along die slivers 34 and a broader part 30 at SMDs 28. While two SMDs 28 are shown in FIGS. 2 and 3, more or fewer devices 28 are possible and/or with other mounting techniques. Also, while devices 28 are positioned at the back of print bar 12 in this example, to allow a substantially flat front print bar surface, it may be desirable in some applications to position devices 28 at the front of print bar 12 or at both the front and back of print bar 12. It is expected that devices 28 will usually be positioned at one end of the print bar to help maintain a uniform, thinner part 32 of molding 26 in the print zone covering the area of fluid dispensing orifices 62.

Figure 10:
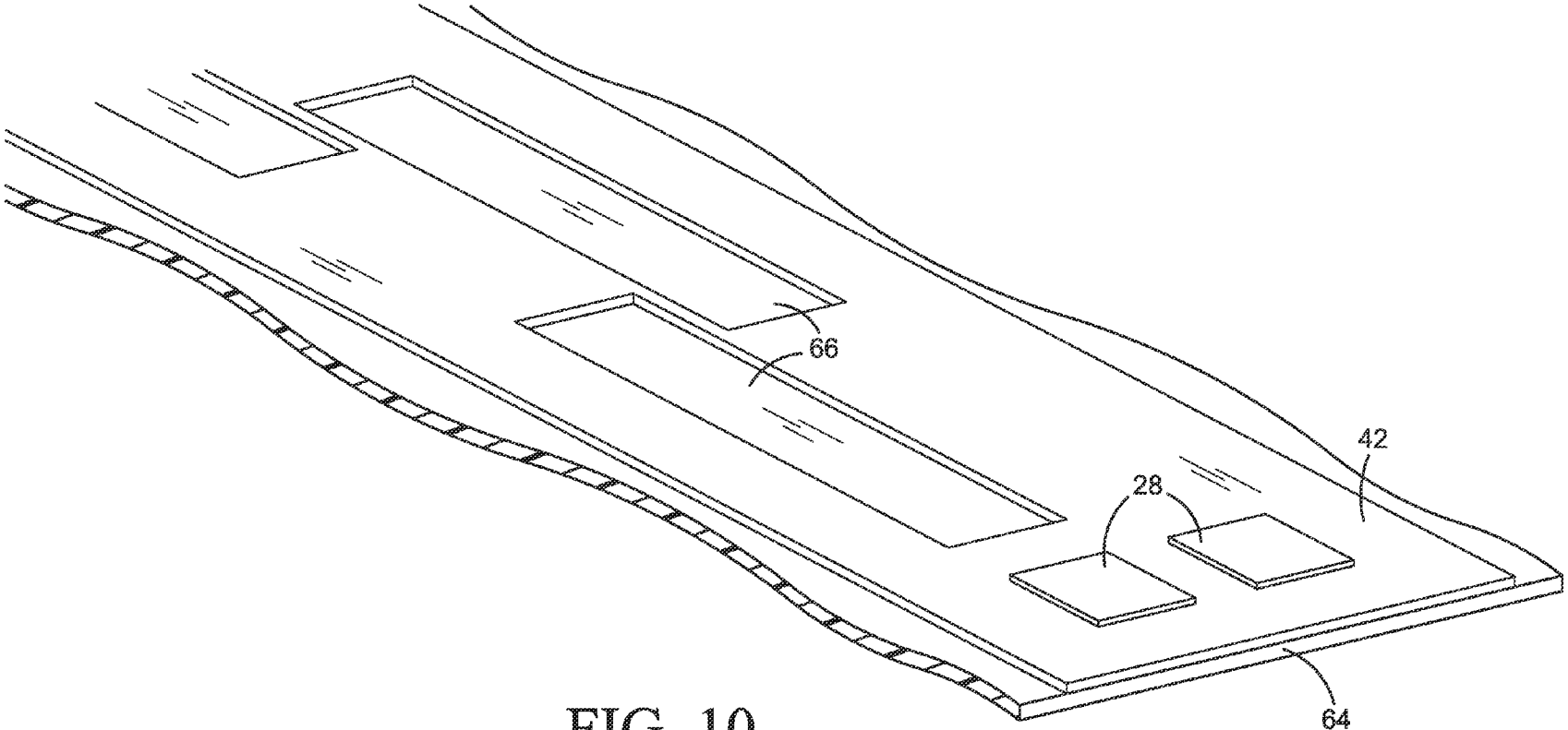
Figure 11:
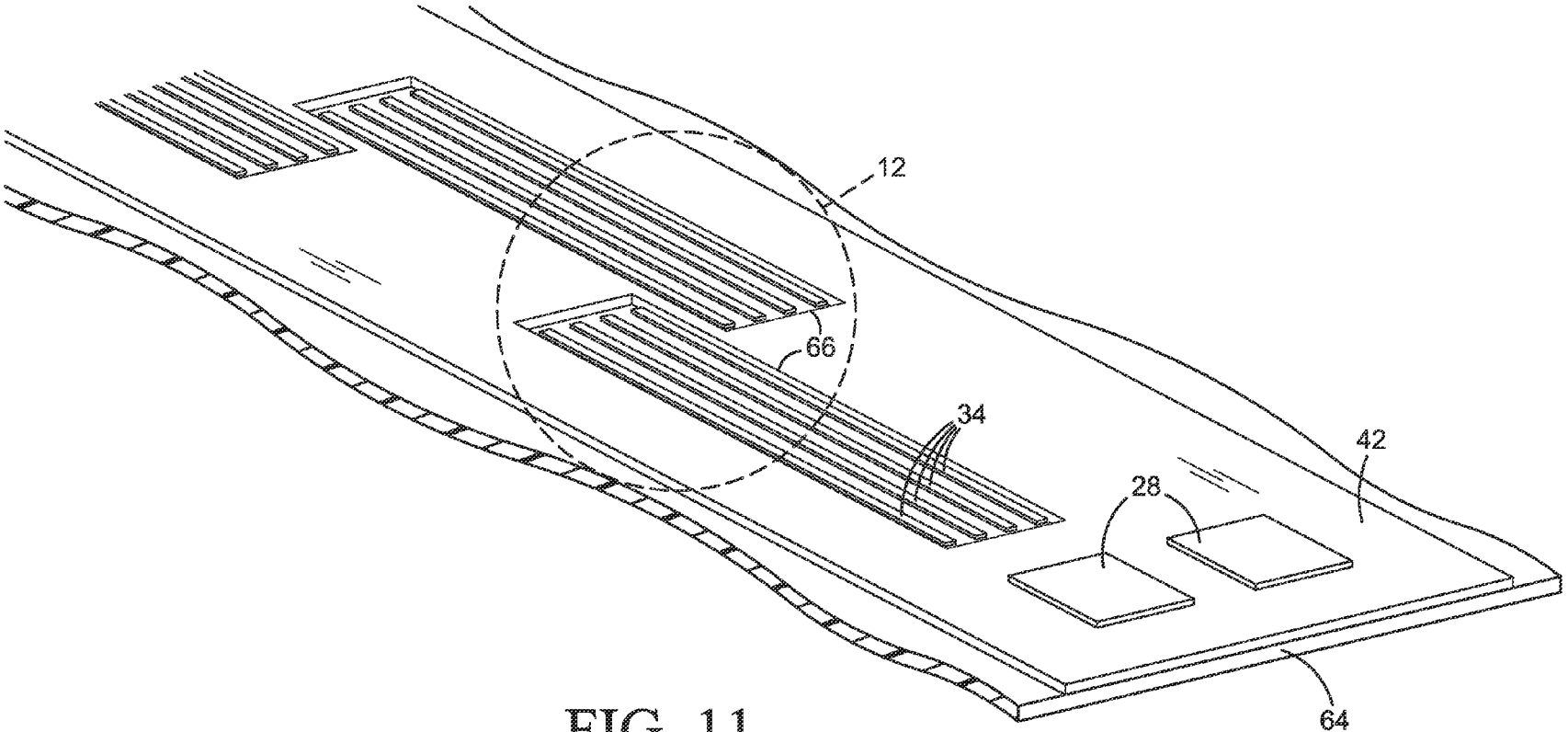
Figure 12:
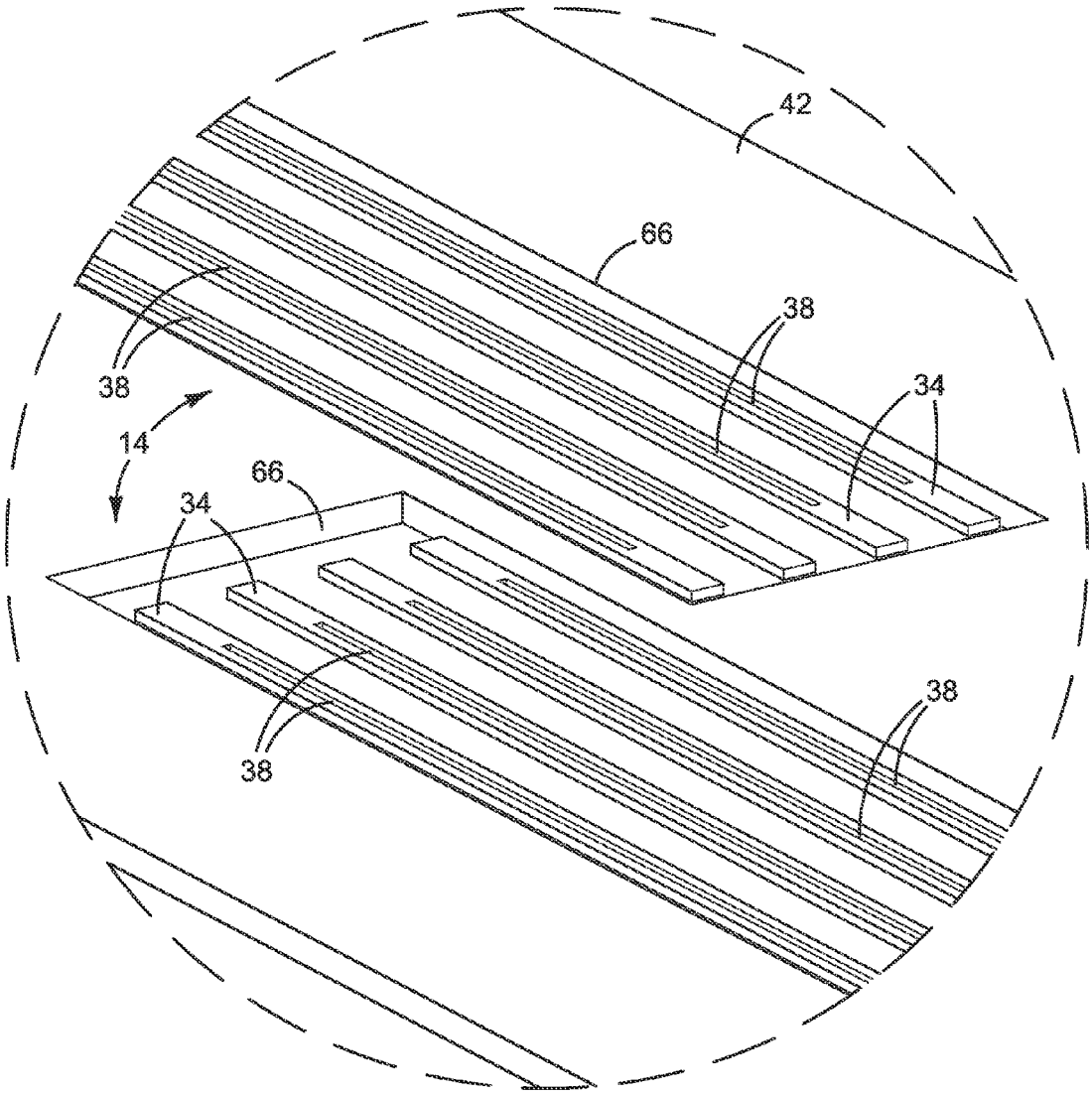

One example process for making a print bar 12 will now be described with reference to FIGS. 10-17 and the flow diagram of FIG. 18. Referring first to FIG. 10, a PCB 42 pre-populated with SMDs 28 is placed on a carrier 64 with a thermal tape or other suitable releasable adhesive (step 102 in FIG. 18). Then, as shown in FIGS. 11 and 12, printhead dies slivers 34 are placed face down on carrier 64 inside openings 66 in PCB 42 (step 104 in FIG. 18). It is expected that multiple print bars will be laid out and molded together on a carrier wafer or panel 64 and singulated into individual print bars after molding. However, only a portion of a carrier panel 64 with part of one print bar in-process is shown in FIGS. 10-12.

Figure 13:
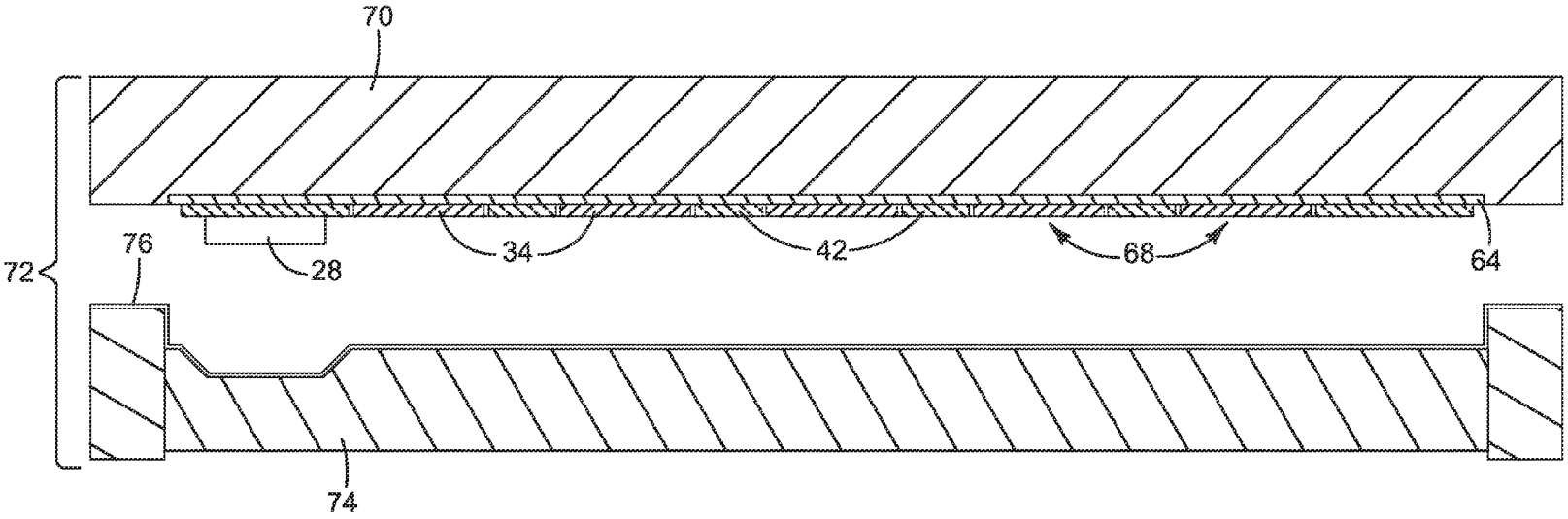
Figure 14:
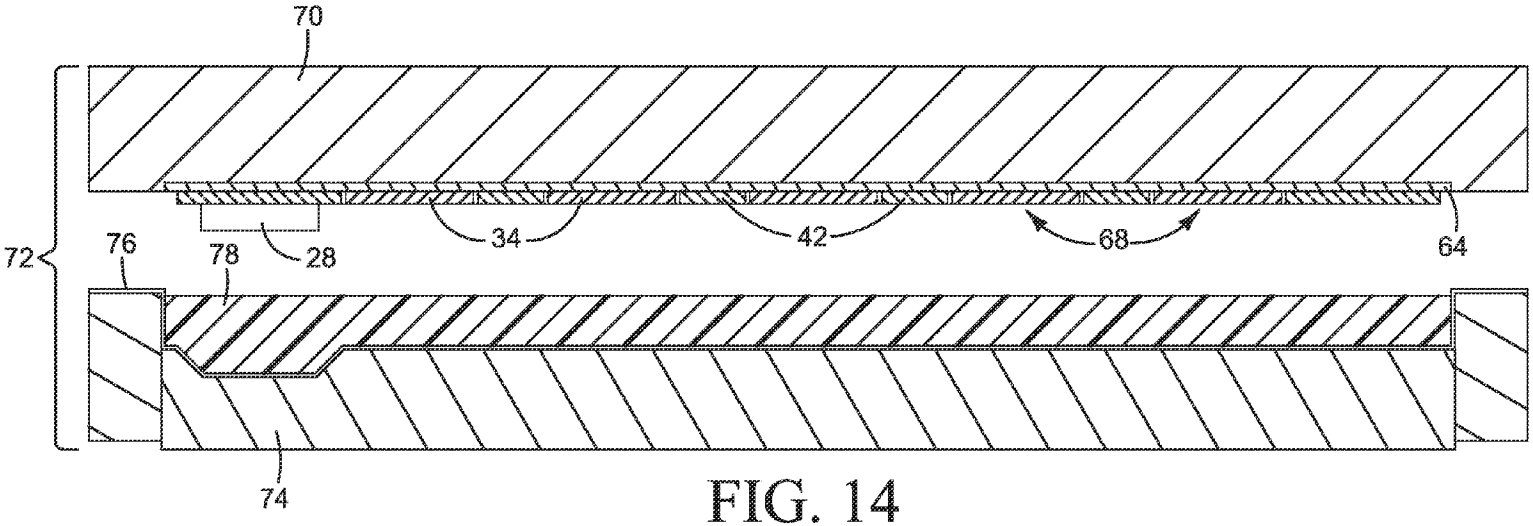
Figure 15:
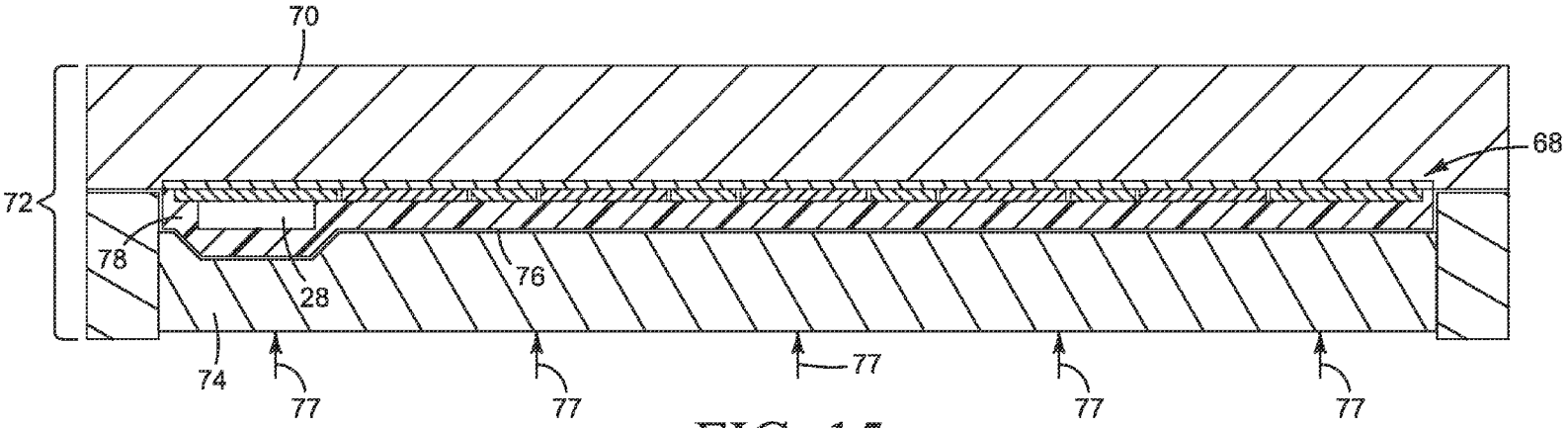
Figure 16:
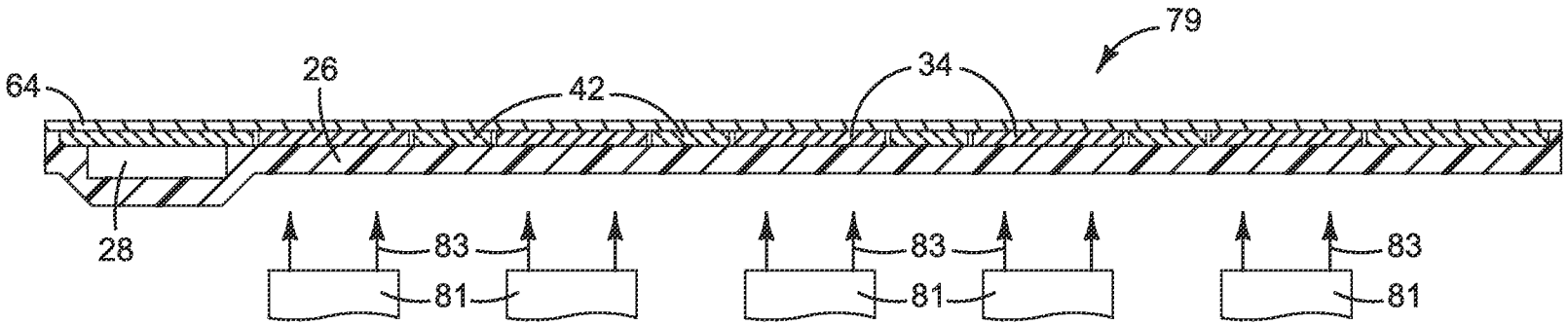
Figure 17:
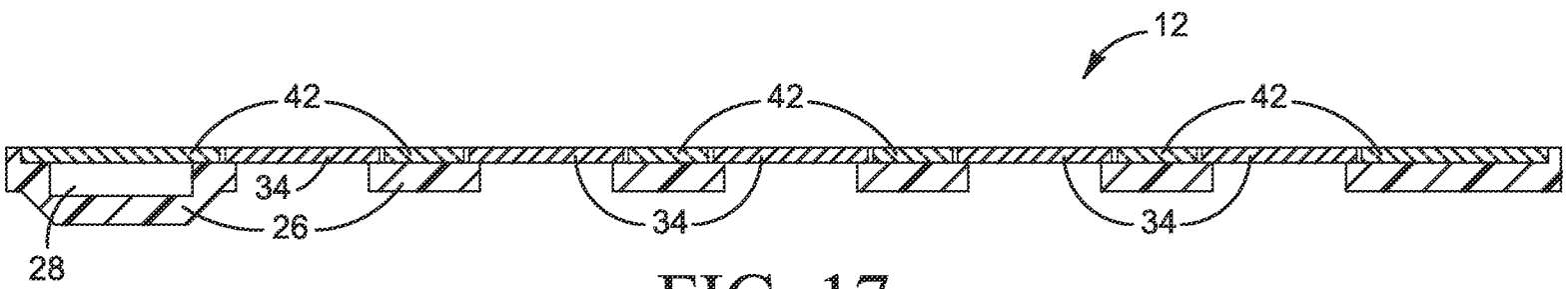

Referring to FIG. 13, the print bar carrier assembly 68 is loaded into the top chase 70 of a molding tool 72 (step 106 in FIG. 18). The bottom chase 74 may be lined with a release film 76 if necessary or desirable to facilitate the subsequent release of the part from the molding tool. In FIG. 14, an epoxy or other suitable mold compound 78 is dispensed into bottom chase 74 (step 108 in FIG. 18) and, in FIG. 15, chases 72 and 74 are brought together as indicated by arrows 77 to form the in-process print bar assembly 79 shown in FIG. 16 (step 110 in FIG. 18). In FIG. 16, the in-process molded print bar assembly 79 is removed from molding tool 72 and channels 36 cut or otherwise formed in molding 26, as indicated generally by saw 81 and arrows 83 in FIG. 16 (steps 112 and 114 in FIG. 18) The in-process structure is released from carrier 64 in FIG. 17 (step 116 in FIG. 18). The printhead die slivers are connected to the PCB conductors to form print bar 12, for example by wire bonding as shown in FIG. 6 (step 118 in FIG. 18).

The order of execution of the steps in FIG. 18 may differ from that shown. For example, it may be desirable in some fabrication sequences to place the printhead dies on the carrier before placing the PCB on the carrier. Also, it may be desirable in some implementations to perform two or more steps concurrently. For example, it may be possible in some fabrication sequences to form the channels in step 114 concurrently with molding the parts in step 110.

FIG. 19 illustrates an ink cartridge 80 implementing one example of a new molded printhead assembly 82. FIGS. 20 and 21 are perspective front and back views, respectively, of the printhead assembly 82 in the ink cartridge 80 shown in FIG. 19. FIGS. 22-25 are detail and section views from FIGS. 19-21. Referring first to FIG. 19, ink cartridge 80 includes a molded printhead assembly 82 supported by a cartridge housing 84. Cartridge 80 is fluidically connected to an ink supply through an ink port 86 and electrically connected to a controller or other external circuitry through electrical contacts 88. Contacts 88 are formed in a so-called "flex circuit" 90 affixed to housing 32. Tiny wires (not shown) embedded in flex circuit 90, often referred to as traces or signal traces, connect contacts 88 to corresponding contacts 54 on printhead assembly 82. The front face of printhead assembly 82 is exposed through an opening 92 in flex circuit 90 along the bottom of cartridge housing 84.

Referring now also to FIGS. 20-25, printhead assembly 82 includes multiple printheads 14 each with printhead die slivers 34 embedded in a monolithic molding 26. Channels 36 formed in molding 26 carry printing fluid directly to the back part of corresponding printhead dies 34. As in the print bar example described above, PCB conductors 40 connect ejector and/or other elements in the IC part 44 of each die 34 to external contacts 54. In this example, however, the wire bonds connecting each die 34 to PCB conductors 40 are at the back part of the dies 34 and buried in molding 26. Also in this example, SMDs 28 are connected to PCB conductors with bond wires 48. As best seen in FIGS. 23 and 25, each bond wire 48 is buried in molding 26. "Back" part in this context means away from the front face of printhead assembly 82 so that the electrical connections can be fully encapsulated in molding 26. This configuration allows the front faces of dies 34, molding 26, and PCB 42 to form a single uninterrupted planar surface across the front face 94 of printhead assembly 82 in the printing area of printheads 14. This configuration allows mechanically robust connections that are largely protected from exposure to ink and, because there are no electrical connections along the front face of the die, the printhead can be made flat and thus minimize protruding structures that might interfere with printhead-to-paper spacing and/or capping and servicing.

"A" and "an" as used in the Claims means one or more.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A printhead, comprising:

a printhead die having a front part along which fluid may be dispensed from the die, the die embedded in a molding having a channel therein through which fluid may pass to a back part of the die, the front part of the die exposed outside the molding and the back part of the die covered by the molding except at the channel;

an external electrical contact electrically connected to the printhead die and exposed outside the molding to connect to circuitry external to the printhead; and a non-printhead die electronic device buried in the molding and electrically connected to an external contact.

2. The printhead of claim 1, wherein:

a thickness of the molding varies from a lesser thickness around the printhead die to a greater thickness away from the printhead die; and the electronic device is buried in the thicker part of the molding.

3. The printhead of claim 2, wherein:

the printhead die comprises multiple printhead dies;

the molding comprises a single, monolithic molding having multiple channels therein each through which fluid may pass directly to the back part of one or more of the printhead dies; and the external contact comprises multiple external contacts and each printhead die is electrically connected to an external contact.

4. The printhead of claim 3, further comprising a printed circuit board embedded in the molding and wherein:

each printhead die is connected to an external contact through a conductor in the printed circuit board;

a front part of the printed circuit board near the printhead dies is exposed outside the molding; and the electronic device is buried in the molding at a back part of the printed circuit board and connected to an external contact through a conductor in the printed circuit board.

5. A print bar including a printhead as recited in claim 4.

6. A printing fluid cartridge including a printhead as recited in claim 4.

7. A print bar, comprising:

an arrangement of multiple printhead dies;

a non-printhead die electronic device at one end of the arrangement of dies; and a monolithic molding covering the dies and the electronic device such that fluid dispensing orifices at a front part of each die are exposed outside the molding and a fluid inlet at a back part of each die is exposed to a channel in the molding, a profile of the molding defining a narrower part along the dies and a broader part at the electronic device.

8. The print bar of claim 7, wherein a thickness of the molding at the broader part is greater than a thickness of the molding at the narrower part.

9. The print bar of claim 7, further comprising a printed circuit board having conductors therein connected to the dies and to the electronic device, the molding covering the printed circuit board such that the molding and printed circuit board together form an exposed planar surface surrounding the dispensing orifices at the front of each of the dies.

10. The print bar of claim 9, wherein:

the electronic device comprises an application specific integrated circuit mounted to a back surface of the printed circuit board;

the fluid dispensing orifices in the dies are exposed at a front part of the molding; and the application specific integrated circuit is buried in a back part of the molding.

11. The print bar of claim 9, wherein each printhead die comprises a printhead die sliver and the die slivers are arranged generally end to end along the molding in a staggered configuration in which a die sliver overlaps an adjacent die sliver.

12. The print bar of claim 9, wherein:

each die is electrically connected to the printed circuit board through a connection outside the molding at a front part of the printed circuit board or through a connection inside the molding at a back part of the printed circuit board; and the electronic device is electrically connected to the printed circuit board through a connection inside the molding at the back part of the printed circuit board.

13. A method for making a molded printhead assembly, comprising:

providing a printed circuit board with a non-printhead die electronic device mounted on a back surface of the printed circuit board;

providing a printhead die having fluid dispensing orifices exposed along a front surface of the printhead die;

placing the printed circuit board front surface down on a carrier;

placing the printhead die front surface down on the carrier;

molding over the printed circuit board, the electronic device, and the printhead die such that the molding is narrower along the printhead die and broader at the electronic device; and forming a channel through the molding to a fluid inlet at a back part of the printhead die.

14. The method of claim 13, further comprising connecting the printhead die to a conductor in the printed circuit board.

* * * * *